US005679408A

United States Patent [19]

Eronen

[11] Patent Number: 5,679,408

[45] Date of Patent: Oct. 21, 1997

[54] METHOD AND DEVICE FOR APPLICATION OF AN ADHESIVE OR EQUIVALENT ONTO A MOVING MATERIAL WEB AND A NOZZLE FOR SAID DEVICE

[75] Inventor: Pekka Eronen, Järvenpää, Finland

[73] Assignee: Valmet Corporation, Helsinki, Finland

[21] Appl. No.: 586,780

[22] PCT Filed: May 18, 1995

[86] PCT No.: PCT/FI95/00265

§ 371 Date: Jan. 19, 1996

§ 102(e) Date: Jan. 19, 1996

[87] PCT Pub. No.: WO95/32058

PCT Pub. Date: Nov. 30, 1995

[30] Foreign Application Priority Data

May 19, 1994 [FI] Finland ..... 942329

[51] Int. Cl.[6] ..... B05B 15/02; B05B 1/00; B05D 1/02

[52] U.S. Cl. ..... 427/424; 427/421; 118/302; 118/324; 118/325

[58] Field of Search ..... 427/421, 424, 427/430.1, 434.3; 118/302, 324, 325, 239, 225, 216, 256, 410

[56] References Cited

U.S. PATENT DOCUMENTS

| | | | |
|---|---|---|---|
| 4,060,651 | 11/1977 | DaMert | 427/285 |
| 4,231,318 | 11/1980 | Zink | 118/122 |
| 4,363,683 | 12/1982 | Diesel | 156/184 |
| 4,596,205 | 6/1986 | Dunajtschik | 118/302 |
| 4,695,485 | 9/1987 | Gibson | 427/256 |
| 4,704,308 | 11/1987 | Maneke et al. | 427/207.1 |
| 4,775,110 | 10/1988 | Welp et al. | 242/56.8 |
| 5,048,454 | 9/1991 | Berntsson | 118/302 |
| 5,136,974 | 8/1992 | Lisec | 118/673 |
| 5,202,164 | 4/1993 | Takahashi et al. | 427/356 |

FOREIGN PATENT DOCUMENTS

| | | |
|---|---|---|
| 65554 | 2/1984 | Finland . |
| 1362315 | 8/1974 | United Kingdom . |

*Primary Examiner*—Shrive Beck
*Assistant Examiner*—Michael Barr
*Attorney, Agent, or Firm*—Steinberg, Raskin & Davidson, P.C.

[57] ABSTRACT

The invention concerns a method for application of an adhesive or equivalent onto a moving material web, wherein the adhesive is applied by means of at least one applicator device (20) through at least one nozzle (30) onto the face of the material web to consititute an adhesive strip (G) in the longitudinal direction of the material web (W). In the method, the material web (W) is made to run at an invariable distance from the nozzle (30) end placed next to the material web (W). The adhesive is passed onto the material web (W) through the nozzle (30) in the applicator head (31) of the applicator device (20), and the applicator head (31) the nozzle (30) for the adhesive washed for the next cycle of use in a container space (23) in the applicator device (20). Further, the invention concerns a device for application of an adhesive or equivalent onto a moving material web (W), which device (20) comprises frame constructions (21, 22, 23), an adhesive-applicator head (31), a container spaced (23), and at least one adhesive nozzle (30). The applicator head (31) is provided with a support face (38) or support faces (34, 35), over which the material web (W) is passed so that the adhesive nozzle (30) is placed at a invariable distance from the material web (W). The device (20) comprises means (32, 33, 34) for transferring the applicator head (31) into the container space (23) and means (24) for washing same. Also, the invention concerns an adhesive nozzle for an adhesive-applicator device.

20 Claims, 5 Drawing Sheets

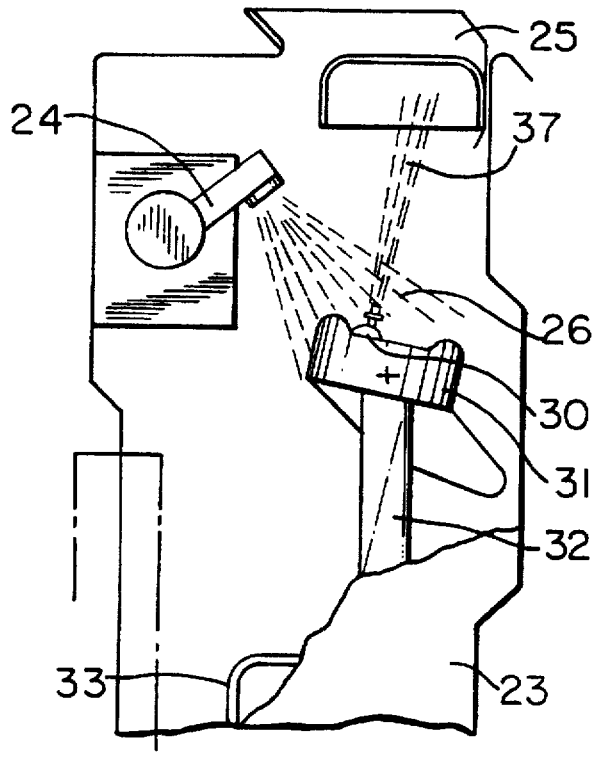
FIG. 3
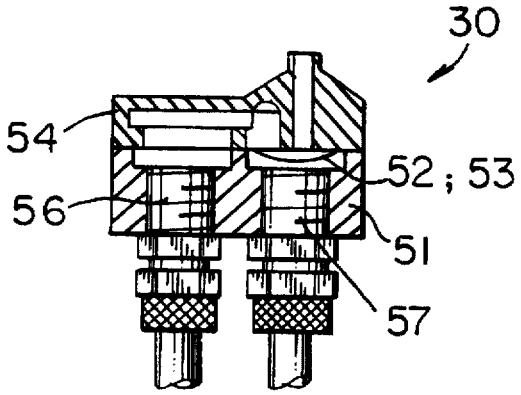
FIG. 4A
FIG. 4B
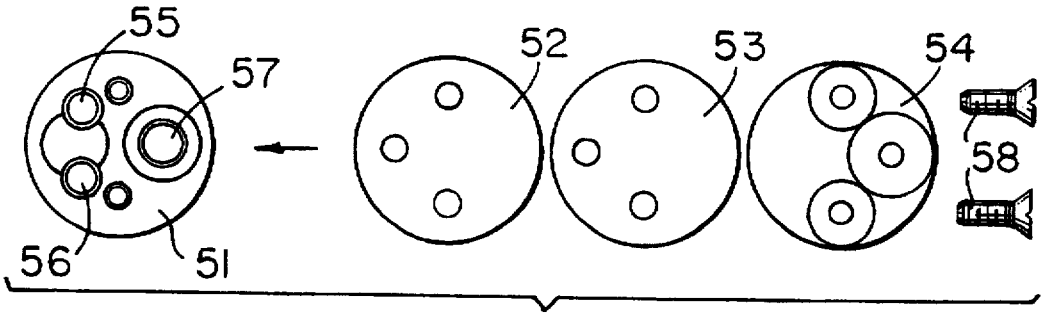

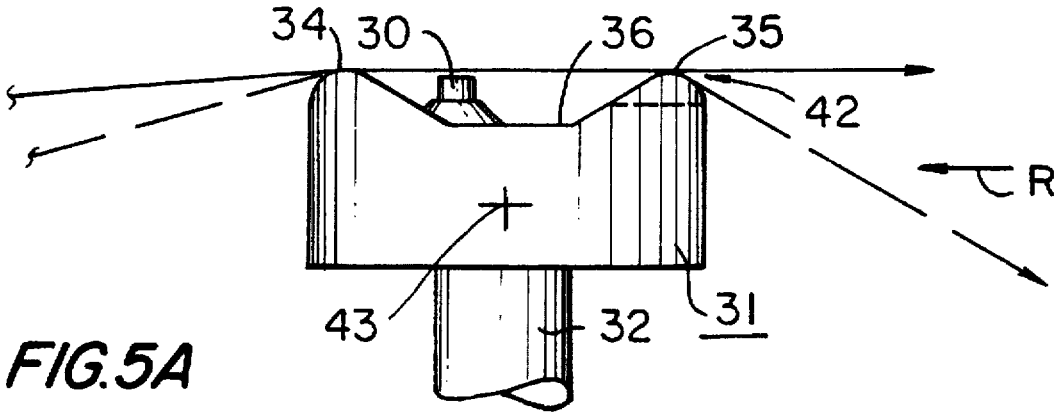
FIG.5A
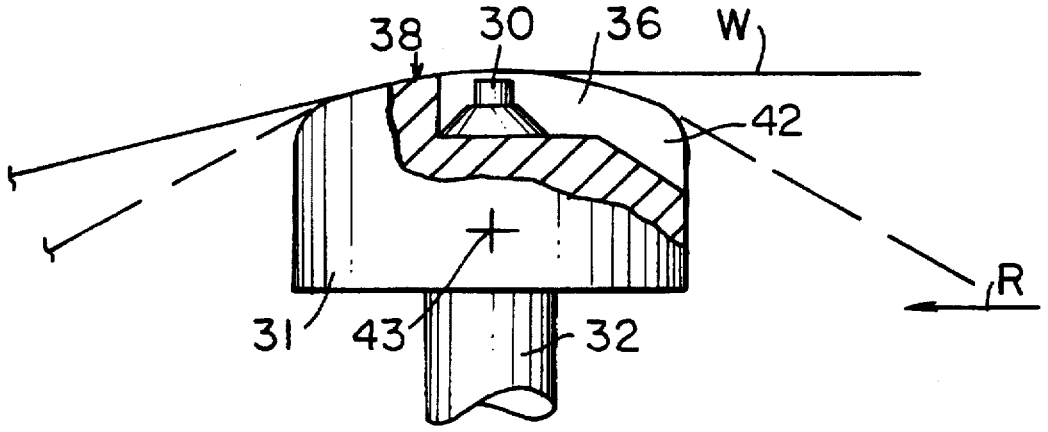
FIG.5B
FIG.6
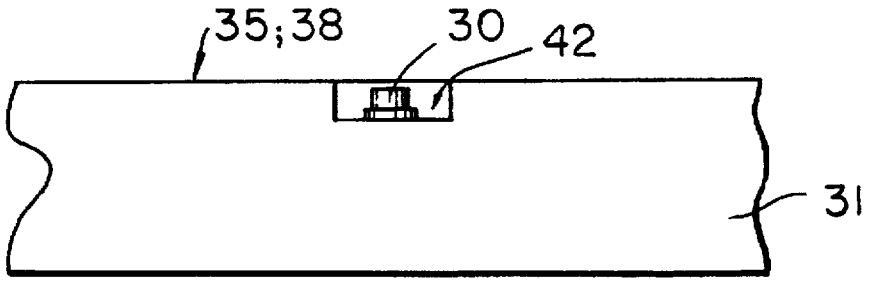

METHOD AND DEVICE FOR APPLICATION OF AN ADHESIVE OR EQUIVALENT ONTO A MOVING MATERIAL WEB AND A NOZZLE FOR SAID DEVICE

This application is a 35 U.S.C. §371 of International patent application No. PCT/FI95/00265 filed May 18, 1995.

The invention concerns a method for application of an adhesive or equivalent onto a moving material web, wherein the adhesive is applied by means of at least one applicator device through at least one nozzle onto the face of the material web to constitute an adhesive strip in the longitudinal direction of the material web.

Further, the invention concerns a device for application of an adhesive or equivalent onto a moving material web, which device comprises frame constructions, an adhesive-applicator head, a container space, and at least one adhesive nozzle.

Also, the invention concerns an adhesive nozzle for an adhesive-applicator device, comprising nozzle parts and parts for the supply of adhesive.

The machine reel produced in a paper machine is often slit in a slitter-winder into component webs, of which customer rolls or commercial rolls of the desired width are formed. Automatic fixing of the curing point, i.e. the "tail", of the commercial rolls produced in the slitter-winder after the winding as well as the gluing of the "initial end" of the web onto the roll spool are to-day ever more important properties in the finishing of paper. In the first place, this comes from the fact that, to-day, ever fewer persons are at work at a slitter-winder at a time, and the roll changes, threading, and other necessary operations take so much of the working time of these people that there is hardly time for manual fixing of the roll tails/initial ends by means of tape or equivalent. Moreover, rolls whose tails have not been fixed produce trouble on the conveyors, and it is a further problem that the roll has time to become slack before it is packaged.

Further, it has been a problem that with manual fixing, for example with so-called liner grades, it is not possible to fix the last layer by gluing across its entire width so that this layer operates as a wrapping or as a part of the wrapping during further transportation of the roll.

From the prior art, solutions are known by whose means attempts have been made to solve some of the problems described above by, in connection with the winder placed after the slitter, placing a device by whose means an adhesive is applied to the surface of the paper web for a certain period of time while the slitter slows down or stops for the roll change.

With respect to the prior art related to this, reference is made to the FI Patents Nos. 64,114, 65,554 and 69,617. In the solutions known from said patents, the application of the adhesive to the web surface is carried out by a tube of a width equal to the width of the machine, adhesive being extruded out of holes that have been drilled into the tube as uniformly spaced. It is a problem in this solution that an individual nozzle cannot be closed, in which case, when a slitting point coincides with said nozzle, adhesive may be carded to the wrong side of the web and from there onto the face of the roll of the winder. Further, in this prior-art solution, the points of starting and ending of the gluing are somewhat inaccurate, because the adhesive valve is placed outside the device far from the point of application of the adhesive. In this prior-art device, the cleaning of the adhesive-applicator head is problematic, and the arrangement of cleaning consumes an abundance of water.

Moreover, the nozzles of the adhesive-application tube have been cleaned manually, which is laborious and takes a lot of time. Further problems in the application of adhesive have arisen from changes in the web angle, because, when the web angle is changed, the point of contact with the web is not placed facing the adhesive-feed opening of the adhesive-applicator device, but at the front or rear of said opening.

With respect to the prior art, reference is also made to the FI Patent No. 91,054, in which a method and a device are described for automatic cutting-off and winding of a product web. In said publication, a solution is also suggested for gluing the end of the web, in which solution the strength of the web is reduced, and the weaker portion is provided with adhesive, which is applied to the web face by means of adhesive-spray nozzles. A problem in this prior-art device is, however, the blocking of the nozzles in connection with the process of application of adhesive. Moreover, the solution involves a number of steps and requires reduction of the web strength.

The object of the present invention is to provide a method and a device for application of an adhesive or equivalent onto the face of a material web and a nozzle included in the device, which apply an adhesive for the desired period of time onto the face of a paper web by means of simple and reliable operations.

It is a particular object of the invention to create a solution that is suitable for use in connection with a slitter-winder when the slitter-winder slows down and stops for the roll change.

It is a further object of the invention to provide a solution in which the points of starting and ending the application of adhesive can be defined precisely.

Also, it is an object of the invention to provide a solution in which it is simple to clean the nozzles and to keep the nozzles clean.

A further object of the invention is a solution in which the strength of the web does not have to be reduced for the point of application of adhesive.

In view of achieving the objectives stated above and those that will come out later, the method in accordance with the invention is mainly characterized in that, in the method, the material web is made to run at an invariable distance from the nozzle end placed next to the material web, that the adhesive is passed onto the material web through the nozzle in the applicator head of the applicator device, and that the applicator head and the nozzle for the adhesive are washed for the next cycle of use in a container space in the applicator device.

The device in accordance with the invention is mainly characterized in that the applicator head is provided with a support face or support faces, over which the material web is passed so that the adhesive nozzle is placed at an invariable distance from the material web, and that the device comprises means for transferring the applicator head into the container space and means for washing same.

Further, the nozzle in accordance with the invention is mainly characterized in that the adhesive nozzle comprises a member for the supply of adhesive, an arrangement for spraying of pressurized water through the interior of the adhesive nozzle, and a membrane arrangement which is fitted to prevent access of water into said adhesive-supply member during washing.

In the arrangement in accordance with the invention, the individual nozzles can be opened and closed. For example, the automatic blade-shifting system of the slitter-winder controls the operation of the adhesive nozzles so that nozzles that are placed at slitting locations or excessively close to said locations are closed. In this way, access of adhesive in the slitting areas to the roll face in the winder is prevented.

In the arrangement in accordance with the invention, the adhesive nozzle has been effected so that the pipe length after the membrane that closes the nozzle is minimized, in which case the advantage is obtained that, when the adhesive nozzle is opened, adhesive comes immediately from the end of the nozzle and, when the nozzle is closed, the supply of adhesive ends immediately. In this way the duration of the period of application of adhesive can be controlled better and, moreover, in stead of a continuous strip of adhesive, it also permits the application of the adhesive as short fragments.

According to the invention, when the device is cleaned, the applicator head is lowered into the container and washed clean with pressurized water. Each adhesive nozzle has a washing nozzle of its own. Thus, the washing is efficient, and economies are obtained in the consumption of water, because the consumption of water is restricted to the time of washing only. The adhesive nozzles can be washed from inside with pressurized water, and the washing takes place automatically. Thus, adhesive is not lost, because the washing is limited to the nozzle, in which the volume of the adhesive that is displaced is little.

Further, in the arrangement in accordance with the invention, any changes in the web angle are taken into account so that the web is passed over two support faces placed apart from one another and the adhesive nozzle is placed between the support faces. When accomplished in this way, the application of the adhesive to the web face is fully insensitive to any changes in the web angle.

BRIEF DESCRIPTION OF THE DRAWINGS

In the following, the invention will be described in more detail with reference to the figures in the accompanying drawing, wherein:

FIG. 3 is a schematic illustration of a washing arrangement of an adhesive nozzle.

FIGS. 4A and 4B are schematic sectional views of an adhesive nozzle.

FIGS. 5A and 5B are schematic illustrations of different alternative embodiments of the shape of the applicator head.

FIG. 6 shows the applicator heads shown in FIGS. 5A and 5B viewed in the direction R.

Figure 1:
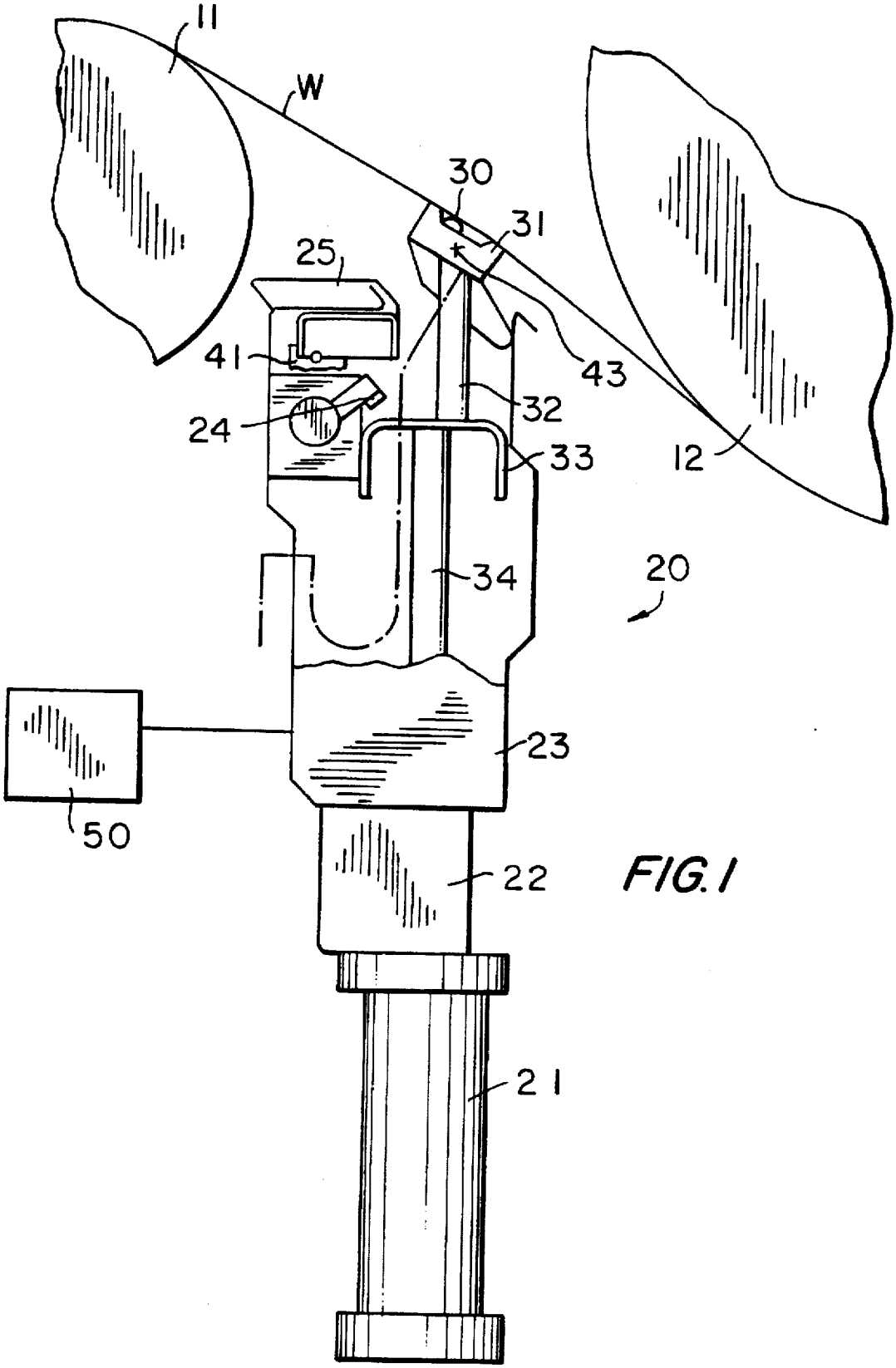
FIG. 1 is a schematic illustration of a device for application of an adhesive in the position for application of adhesive.
Figure 7:
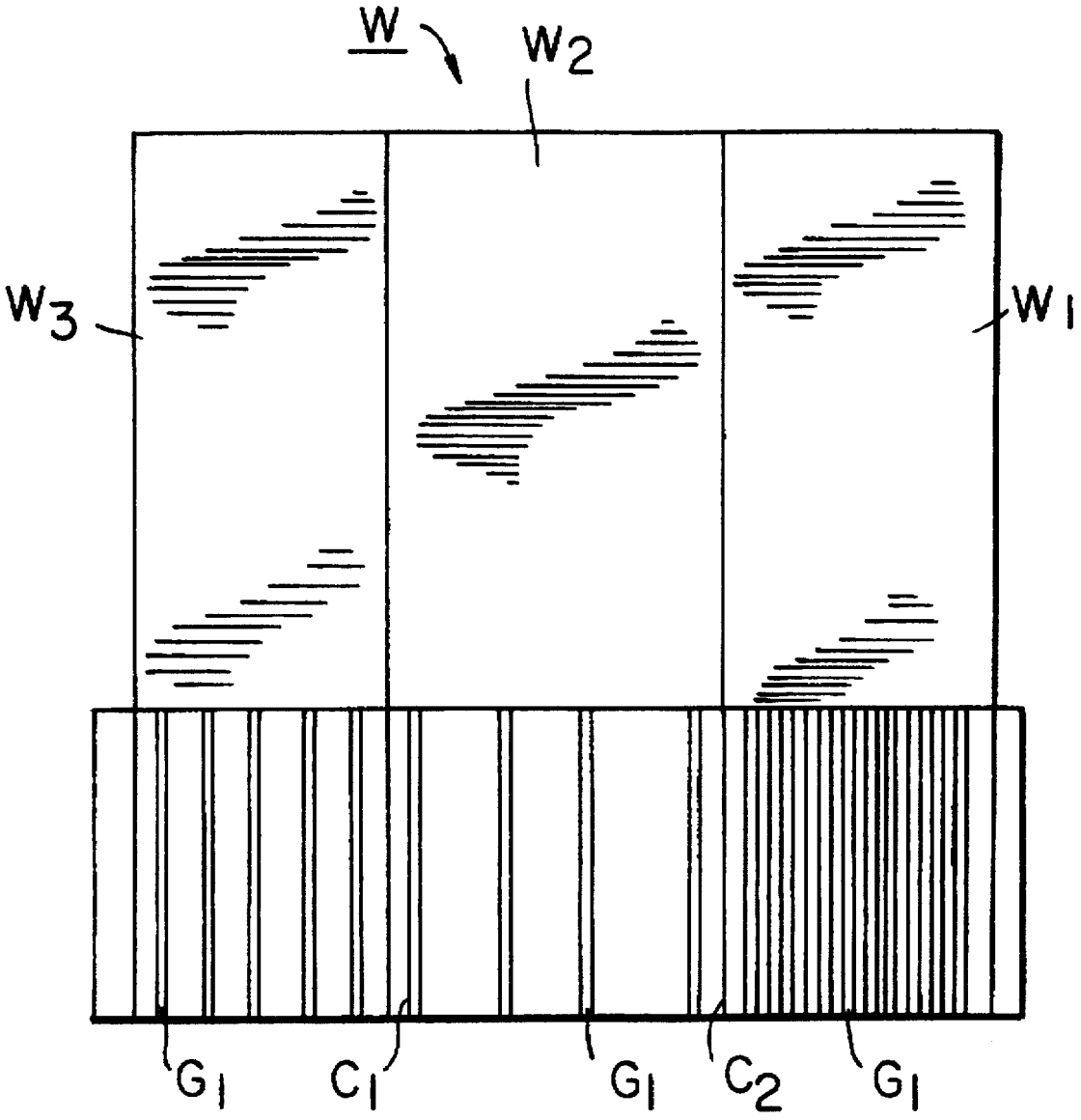
FIG. 7 is a schematic illustration of the web to be provided with an adhesive, seen from the side of application of adhesive.

The adhesive-applicator device 20 as shown in FIG. 1 consists of a container 23, whose frame constructions are denoted with the reference numeral 22. Connected with the container 23, there is the adhesive-applicator head 31 with its adhesive nozzles 30, the washing nozzles 24 for the applicator head 31, and the systems of levers 41 necessary for opening and closing the lid 25 of the container 23. Underneath the container 23 and its frame constructions 22, there are actuators necessary for raising and lowering the applicator head 31, such as compressed-air cylinders 21. The adhesive-applicator device 20 is mounted, for example, on two lifting devices, such as screw devices, which permit vertical adjustment of the device 20 and lowering of the device to the servicing position (not shown). In the situation as shown in FIG. 1, the adhesive-applicator device 20 is shown in the adhesive-application position, in which the lid 25 of the container 23 has been opened and the applicator head 31 has been raised into contact with the lower face of the moving paper web W. The adhesive nozzles 30 apply the adhesive as strips G onto the paper web W (FIG. 7). In the figure, the paper web W moves from the web guide roll 11 over the roll 12 of the winder onto the paper or equivalent roll. The arm constructions of the applicator head 31 are denoted with the reference numerals 32 and 34.

There are one or several adhesive-applicator devices 20 placed side by side in the cross direction of the web W, and the operation of each adhesive-applicator device is controlled by means of a control system 50, which operates, for example, jointly with the automatic blade-shifting system of the slitter-winder. The nozzles 30 of the applicator head 31 that are placed at, or excessively near, the locations of web slitting C (FIG. 7) are closed in accordance with instructions given by the control system 50. The control system 50 also controls the start and finish of the operation of the device 20 as well as the washing operations. The control system 50 may also control the device 20 so that, in stead of a continuous adhesive strip G (FIG. 7), a fragmentary adhesive strip is formed.

Figure 2:
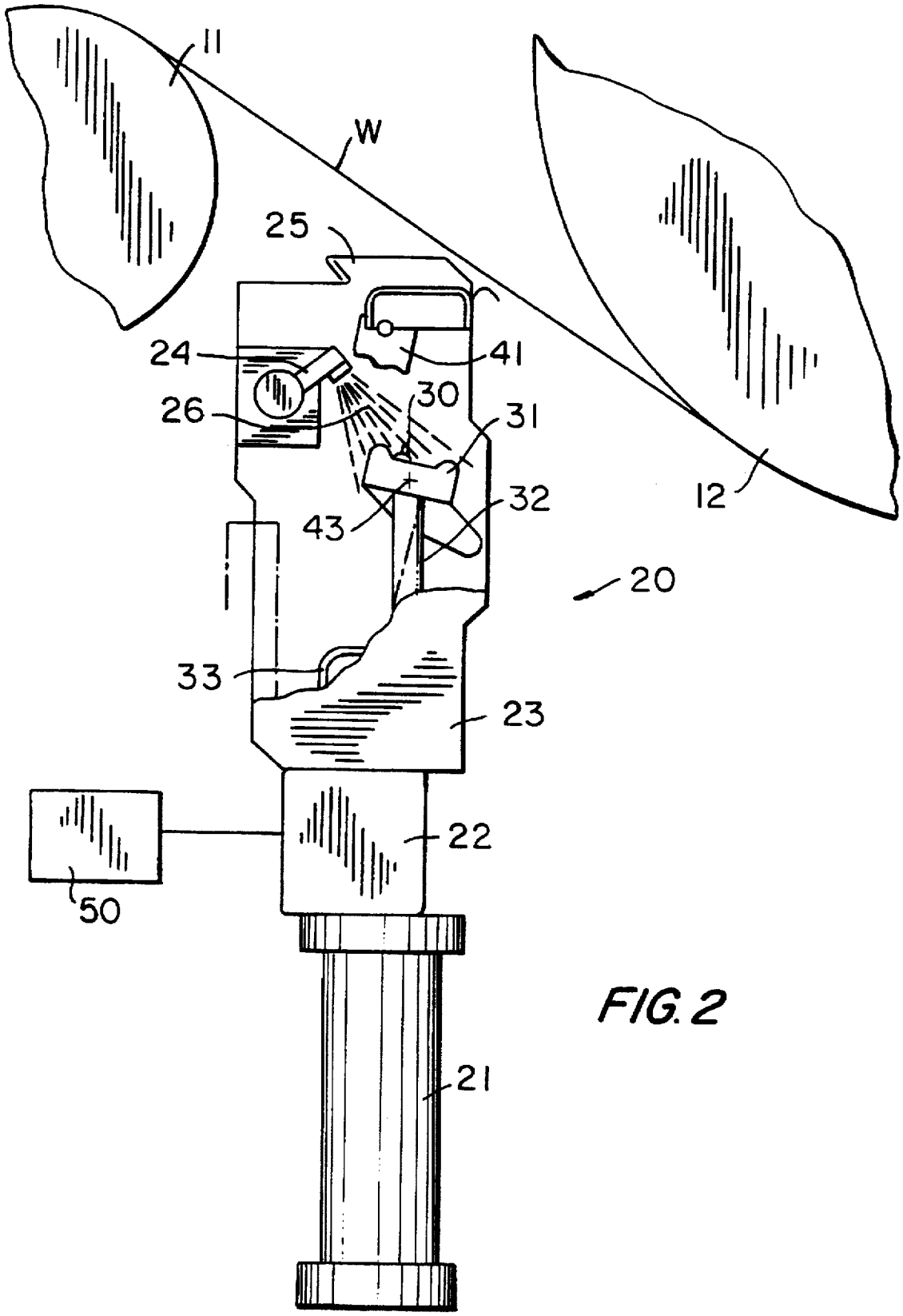
FIG. 2 is a schematic illustration of the device for application of an adhesive during washing.

In FIG. 2, the adhesive-applicator device is shown in the basic position. The applicator head 31 with its adhesive nozzles 30 has been pulled into the container 23 of the adhesive-applicator device, and the lid 25 is closed, and the washing nozzles 24 wash the applicator head 31 to clean it for the next cycle of use. The washing nozzles 24 spray pressurized water 26, with which the applicator head 31 and the nozzles 30 placed in the interior of the container 23 are washed clean.

FIG. 3 is a more derailed illustration of the inside washing of an adhesive nozzle 30 in the applicator head 31. When the applicator head 31 of the adhesive-applicator device 20 is washed inside the container 23, water 37 can be sprayed through the adhesive nozzle 30 of the applicator head 31, whereby the nozzle can also be cleaned.

As is shown in FIGS. 4A . . . 4B, the adhesive nozzle 30 comprises a lower frame part 51, on which membrane members 52 and 53 have been fitted, for example first a membrane fabric 52 and on it a membrane made, for example, of PTFE. The upper frame part 54 is attached to the lower frame part, for example, by means of screws 58. The adhesive nozzle 30 comprises an adhesive inlet opening 55, a water inlet opening 56, and a compressed-air opening 57. Thus, the adhesive nozzle 30 can be washed clean from inside with pressurized water, and the arrangement can be carried out automatically. Then, no adhesive is lost, because the washing is limited to the nozzle 30, in which the volume of the adhesive that is displaced is little.

FIGS. 5A and 5B are schematic illustrations of exemplifying embodiments of some shapes of the applicator head. The applicator head 31 is fixed to an arm 32, and an adhesive nozzle 30 is placed at the end of the applicator head 31 placed at the side of the web W. The adhesive nozzle 30 is placed in a recess 36 between the support faces 34 and 35, FIG. 5A, or in a recess placed in the middle of the support face 42, FIG. 5B.

FIG. 6 is a schematic illustration of an applicator head viewed in the direction R indicated in FIGS. 5A and 5B.

FIG. 7 illustrates component webs $W_1$,$W_2$,$W_3$ which have been formed out of the web W by means of a slitter-winder, being cut at the locations $C_1$,$C_2$, and the adhesive strips made by means of the adhesive nozzles 30 are denoted with the reference G.

In the arrangement in accordance with the invention, the adhesive-applicator device 20 comprises one adhesive nozzle 30 or several adhesive nozzles 30 placed side by side in the direction of width of the web W, and the nozzles 30 of the adhesive-applicator device 20 that are placed at a slitting location $C_1$,$C_2$ are closed in order that the adhesive should not spread to the other side of the web. There may also be one or several adhesive-applicator devices 20 placed side by side in the direction of width of the web W.

In the following, the invention will be described further, reference being made to all of the illustrations explained above. The paper web W has been made to run at an invariable distance from the adhesive-applicator head of the nozzle 30, and said invariable distance is obtained by passing the paper web W over two support faces 34,35 placed apart from one another in the running direction of the paper web W or over a support face 38 that has been formed around the recess 36 of the adhesive nozzle 30, either along a linear path or along a curved path (FIGS. 5A,5B, solid line, dashed line, respectively) and by placing the adhesive-applicator head of the nozzle 30 facing a support face 34,35;38 or at any location whatsoever between said support faces. Seen in the running direction of the paper web W, the rear support face 35 or portion of support face 38, which maintains the invariable distance of the web from the nozzle 30 end, is provided with openings 42 at the location of the nozzle 30. The support faces 34,35;38 which maintain the invariable distance of the web W from the nozzle 30 end are provided with articulated joints 43 so as to be pivotal. Any changes in the web angle on arrival at the support faces 34,35;38 and also on leaving said support faces do not affect the invariable distance of the web W from the nozzle 30 end.

The adhesive nozzle 30 can be washed from inside by passing the pressure of water behind the membrane that closes the nozzle 30 and by, by means of said membrane 52,53, preventing the access of water into the adhesive supply pipe 55. An adhesive nozzle 30 that does not participate in the application of adhesive can be opened in the container 23 and closed after a while and washed clean (FIG. 2). In this way, the operation of the adhesive nozzle 30 is ensured when it is needed again. Individual adhesive nozzles 30 in the direction of width of the web can be opened and closed in the desired way. The adhesive-applicator head 31 and the nozzles 30 are washed clean with pressurized water 26 for the next cycle of use. Through the washing nozzles 24, it is also possible to blow compressed air to dry the adhesive-applicator head 31 after washing.

Above, the invention has been described with reference to some preferred exemplifying embodiments of same only, which is, however, by no means supposed to restrict the invention strictly to said exemplifying embodiments alone. Many variations and modifications are possible within the scope of the inventive idea defined in the following patent claims.

I claim:

1. A method for applying an adhesive onto a moving material web, comprising the steps of:

arranging at least one nozzle in an applicator head of an applicator device, said applicator head having at least one support face fixed relative to said at least one nozzle, moving said applicator head toward the material web until said at least one support face of said applicator head directly contacts the material web such that the material web passes at a substantially constant distance from said at least one nozzle in said applicator head, directing the adhesive through said at least one nozzle onto a face of the material web to form an adhesive strip in the longitudinal direction of the material web, and washing said at least one nozzle and said applicator head in a container space defined in said applicator device.

2. The method of claim 1, wherein the adhesive is directed at intervals onto the face of the material web, said at least one nozzle and said applicator head being washed between intervals in said container space.

3. The method of claim 1, wherein said applicator device comprises a plurality of nozzles, further comprising the step of arranging said plurality of nozzles in a row in a transverse direction of the material web and to extend across the width of the web.

4. The method of claim 1, wherein the step of washing said at least one nozzle and said applicator head comprises the step of spraying said at least one nozzle and said respective applicator head with pressurized water.

5. The method of claim 1, further comprising the step of drying said at least one nozzle and said applicator head with compressed air after said washing step.

6. The method of claim 1, wherein the step of directing the adhesive through said at least one nozzle onto a face of the material web comprises the step of passing the adhesive onto the face of the material web as at least one respective continuous or fragmented adhesive strip.

7. The method of claim 3, wherein the step of directing the adhesive through said at least one nozzle onto a face of the material web comprises the step of passing the adhesive onto the face of the material web from each of said nozzles as a continuous or fragmented adhesive strip.

8. The method of claim 1, wherein said applicator device comprises a plurality of nozzles arranged in said applicator head and to extend across the width of the web, further comprising the step of independently controlling the application of adhesive through each of said nozzles.

9. A device for applying an adhesive onto a moving material web, comprising a frame, a container coupled to said frame and defining a space therein, an adhesive applicator head coupled to said container, said applicator head including at least one support face, transfer means coupled to said applicator head for transferring said applicator head between a first position in which the material web passes in direct contact with said at least one support face of said applicator head and a second position in which said applicator head is situated in said container space, at least one adhesive nozzle arranged in said applicator head for applying adhesive to the material web when said applicator head is in said first position, said at least one support face being fixed relative to said at least one nozzle such that said at least one nozzle is situated at a substantially constant distance from the material web when said applicator head is in said first position, and washing means for washing said at least one nozzle and said applicator head when said applicator head is in said second position.

10. The device of claim 9, wherein said at least one support face extends above an outlet of said at least one nozzle across the width of the web and includes a respective opening aligning with said at least one nozzle.

11. The device of claim 9, further comprising articulation means coupled to said at least one support face of said applicator head for enabling said at least one support face head to pivot to maintain said at least one nozzle at a substantially constant distance from the material web.

12. The device of claim 9, further comprising a lid for closing said container space when said applicator head is in said second position.

13. The device of claim 9, wherein said washing means comprise a water-spray nozzle.

14. The device of claim 9, wherein said applicator head further comprises a compressed-air nozzle for drying said applicator head.

15. The device of claim 9, wherein said frame, said container, said adhesive applicator head, said transfer means, said at least one adhesive nozzle and said washing means are situated on one side of the web.

16. The device of claim 9, wherein said transfer means comprise an actuator for displacing said applicator in a vertical direction toward and away from the web.

17. A device for applying an adhesive onto a plurality of adjacent, moving material web, comprising a frame, a container coupled to said frame and defining a space therein, an adhesive applicator head coupled to said container, said applicator head including at least one support face, transfer means coupled to said applicator head for transferring said applicator head between a first position in which the material web passes in direct contact with said at least one support face of said applicator head and a second position in which said applicator head is situated in said container space, a plurality of adhesive nozzles arranged in said applicator head, at least one of said nozzles being structured and arranged to apply adhesive to a respective one of the material webs when said applicator head is in said first position, said at least one support face being fixed relative to said nozzles such that said nozzles are situated at a substantially constant distance from the material web when said applicator head is in said first position, and washing means for washing said nozzles and said applicator head when said applicator head is in said second position.

18. In a reel-up apparatus in which at least one material web runs from a paper guide roll over a winder roll to be reeled, a device for applying an adhesive to the at least one web at a location between the paper guide roll and the winder roll comprising a frame, a container coupled to said frame and defining a space therein, an adhesive applicator head coupled to said container, said applicator head including at least one support face, transfer means coupled to said applicator head for transferring said applicator head between a first position in which the at least one web passes in direct contact and over said at least one support face of said applicator head and a second position in which said applicator head is situated in said container space, at least one adhesive nozzle arranged in said applicator head for applying adhesive to the at least one web when said applicator head is in said first position, said at least one support face being fixed relative to said at least one nozzle such that said at least one nozzle is situated at a substantially constant distance from the at least one web when said applicator head is in said first position, and washing means for washing said at least one nozzle and said applicator head when said applicator head is in said second position.

19. The device of claim 18, wherein said transfer means comprise an actuator for displacing said applicator head until the material web directly contacts said at least one support face of said applicator head when said applicator head is in said first position.

20. The device of claim 18, wherein the device applies adhesive onto a plurality of webs and comprises a plurality of nozzles, at least one of said nozzles being structured and arranged to apply adhesive to a respective one of the webs when said applicator head is in said first position.

* * * * *